US006349691B1

(12) United States Patent
Klein

(10) Patent No.: US 6,349,691 B1
(45) Date of Patent: Feb. 26, 2002

(54) AUTOMATIC, PRESSURE RESPONSIVE AIR INTAKE VALVE FOR INTERNAL COMBUSTION ENGINE

(76) Inventor: Jeffrey F. Klein, 4652 Wilkens Ave., Baltimore, MD (US) 21229

( * ) Notice: Subject to any disclaimer, the term of this patent is extended or adjusted under 35 U.S.C. 154(b) by 0 days.

(21) Appl. No.: 09/561,494

(22) Filed: Apr. 28, 2000

(51) Int. Cl.[7] ..... F02M 23/06
(52) U.S. Cl. ..... 123/188.4
(58) Field of Search ..... 137/907, 526; 251/325; 123/188.4, 188.9, 188.1, 188.2, 90.14

(56) References Cited

U.S. PATENT DOCUMENTS

| | | | | |
|---|---|---|---|---|
| 1,147,085 A | | 7/1915 | Gray | |
| 1,557,829 A | | 10/1925 | Greiner et al. | |
| 1,695,186 A | * | 12/1928 | Good | |
| 1,905,140 A | | 4/1933 | Boyce | |
| 2,819,704 A | | 1/1958 | Niederman | |
| 3,017,872 A | | 1/1962 | Candelise | |
| 3,331,361 A | | 7/1967 | Baudry | |
| 4,064,854 A | | 12/1977 | Fehrenbach et al. | |
| 4,071,044 A | | 1/1978 | Jones | |
| 4,631,917 A | | 12/1986 | Wales | |
| 4,976,237 A | | 12/1990 | Bollinger | |
| 5,005,537 A | * | 4/1991 | Maissant | 123/90.14 |
| 5,363,651 A | * | 11/1994 | Knight | 123/90.14 |
| 5,524,579 A | | 6/1996 | Eluchans | |
| 5,752,477 A | * | 5/1998 | Dabadie | 123/90.14 |
| 6,257,180 B1 | * | 7/2001 | Klein | 123/70 R |

FOREIGN PATENT DOCUMENTS

GB 6800 A * 3/1905

* cited by examiner

*Primary Examiner*—Henry C. Yuen
*Assistant Examiner*—Hyder Ali
(74) *Attorney, Agent, or Firm*—Law Offices of Royal W Craig

(57) ABSTRACT

An automatically actuated, pressure responsive air intake valve for an internal combustion engine generally a fixed valve seat housing and a sliding valve member. The valve seat housing is threaded into the head of a working chamber on an internal combustion engine. The sliding valve member reciprocates through the housing in response to differential pressures on either side of the valve. The sliding member has a hollow chamber that opens in a sidewall of the valve seat housing, thereby directing a stream of air outward from the valve structure. By providing multiple valves in the head of the cylinder, a swirling effect may be accomplished to better distribute the fuel/air mixture and enhance cooling of the cylinder.

10 Claims, 3 Drawing Sheets

AUTOMATIC, PRESSURE RESPONSIVE AIR INTAKE VALVE FOR INTERNAL COMBUSTION ENGINE

BACKGROUND OF THE INVENTION

1. Field of the Invention

The present invention relates to valve structures and, more particularly, to an improved, automatically actuated, pressure responsive air intake valve for use in an internal combustion engine.

2. Description of the Background

Internal combustion engines produce power through operation of the well known "Otto Cycle" which is characterized by the ignition of a fuel/air mixture within a power cylinder of the engine. The Otto Cycle, whether in a four cycle or two cycle engine, involves the introduction of the fuel and air into the working chamber of the engine, compression of the fuel/air mixture by a piston, ignition of the fuel/air mixture within the working chamber above the piston to cause power motion of the piston, and exhaust of the spent combustion gases from the working chamber. The inlet and exhaust of air and combustion gases from the working chamber are traditionally achieved through valved openings which control the flow of fuel mixture and combustion gases to and from the cylinder.

Several attempts have been made in the past to modify the structure of air intake valves to in turn increase the efficiency of the engine, but only to limited success. However, a significant need remains in the art to provide an air intake valve of simplified construction and which is less expensive than devices previously known, and which provides consistent, automatic actuation without the need for cams or other mechanically, electrically, or otherwise actuated devices.

SUMMARY OF THE INVENTION

It is, therefore, an object of the present invention to provide an improved air intake valve for an internal combustion engine which avoids the disadvantages of the prior art.

It is another object of the present invention to provide an air intake valve for an internal combustion engine capable of improving the performance of an internal combustion engine, and which is of simplified construction and less expensive to manufacture than previously known air intake valves.

According to the present invention, the above-described and other objects are accomplished by providing an improved, automatically actuated, pressure responsive air intake valve for an internal combustion engine comprising two primary components, namely, a fixed valve seat housing and a sliding valve member. The valve seat housing is preferably threaded into an opening in the head of a working chamber on an internal combustion engine, or may alternately be machined directly into the head. The sliding valve member is configured to reciprocate through the hollow interior of the valve seat housing (whether configured as a member threaded into the head or as an integrally machined opening within the head) in response to differential pressures on either side of the valve. The sliding member has a hollow chamber running along its interior parallel to its primary axis, and has a single, round opening in a sidewall at the base of the slider member adjacent the valve seat face on the housing. The boring of the interior of the slider member is accomplished such that a smooth transition is provided for directing the stream of air outward from the valve structure. The internal surface of the bore follows the contour of a partial sphere in order to turn the stream of air traveling through the valve from a direction parallel to the primary axis of the valve to a direction perpendicular or nearly perpendicular to the primary axis of the valve, and in a coherent stream, without the omni dispersal (i.e., the dispersal in all directions more or less perpendicular to that of the axis of the sliding direction of the valve) common to the usual type of intake valve used in most internal combustion engines. By providing multiple valves in the head of the cylinder, each of which is arranged so that its discharge is neither parallel to, nor opposite that of any other, a swirling effect may be accomplished which enhances the cooling effect of the admitted air on the power cylinder's components (in turn reducing the wear and tear on the same), and more efficiently mixing the fuel/air mixture to provide for increased overall engine efficiency and reduced fuel consumption.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
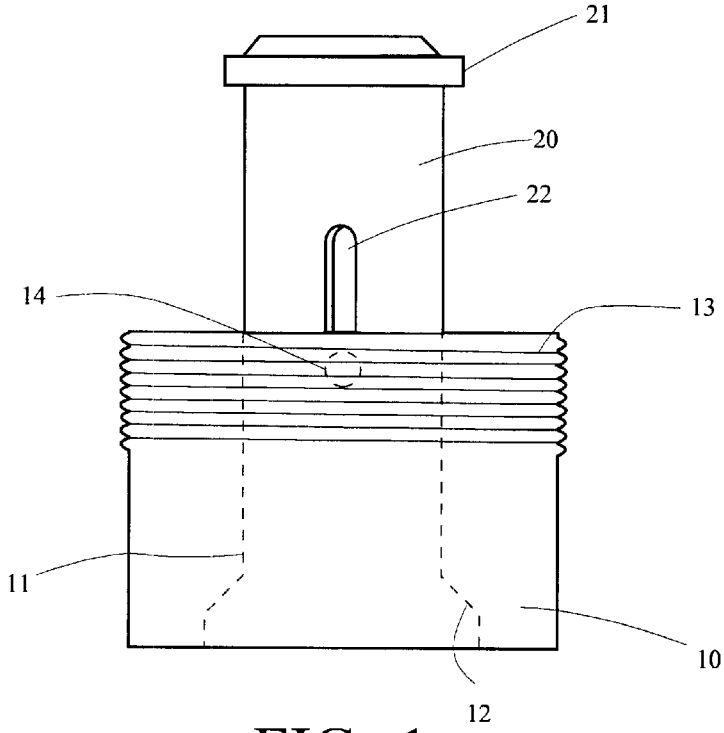
FIG. 1 is a front view of the assembled valve of the instant invention in a closed position.

As shown in the front view of FIG. 1, the automatically actuated, pressure responsive air intake valve of the instant invention is comprised of a valve seat housing 10 and a slider valve member 20 configured to reciprocate through the hollow interior of valve seat housing 10, automatically opening and closing in response to differential pressures on either side of the valve of as little as 1 psi.

Valve seat housing 10 comprises a generally cylindrical body preferably formed of a hard metal having a bore extending there through. The bore in valve seat housing 10 is configured as an elongate, cylindrical bore 11 extending from the top face of housing 10 to slightly above the bottom face of housing 10, and a flared valve seat 12 interposed between cylindrical bore 11 and the bottom face of housing 10. As explained in greater detail below, flared valve seat 12 is configured to mate with the bottom flared portion 23 of slider valve member 20 when the valve is closed. Extending radially inward from the sidewall of cylindrical bore 11 is a positioning pin 14. As explained in greater detail below, positioning pin 14 is configured to ride within a channel 22 on slider valve member 20 to prevent the rotation of slider valve 20 about its primary axis, thus maintaining the air flow from the valve in the desired direction during operation. Valve seat housing 10 is preferable provided along at least a portion of its external cylindrical wall with a series of threads 13 configured to mount valve seat housing 10 in a cooperating screw-threaded opening provided in the head of a cylinder in an internal combustion engine.

Figure 2:
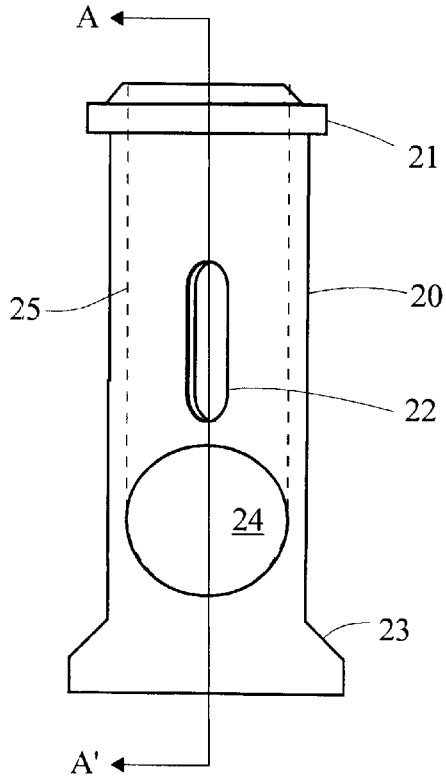
FIG. 2 is a front view of the slider valve member.

As shown more particularly in the side view of slider valve 20 of FIG. 2, slider valve 20 comprises a generally elongate shaft preferably formed of steel or ceramic, or a similarly configured hard and temperature resistant material, having a flared face 23 at its bottom portion. Flared face 23 is contoured to mate with flared valve seat 12 on valve housing 10, such that when the valve assembly is in its fully closed position (as shown in FIG. 1), the bottom-most portion of slider valve 20 lies flush with the bottom face of valve housing 10. Slider valve 20 is provided at its upper portion with an annular ring 21 rigidly attached to slider valve 20. Annular ring 21 serves as a stop to limit the downward travel of slider valve member 20 as it reciprocates through valve housing 10 to open and close the valve assembly.

Figure 3:
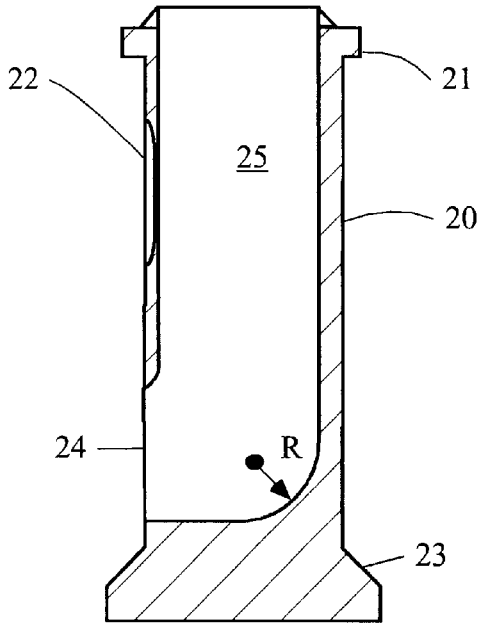
FIG. 3 is a partial cross-sectional view of the slider valve member taken along line A—A of FIG. 2.

Slider valve 20 is likewise provided near its bottom portion with a circular air outlet port 24 positioned in a sidewall of slider valve member 20. Air outlet port 24 opens into and intercepts a vertical bore 25 extending through a majority of the slider valve member's major axis. As shown more particularly in the partial cross-sectional view of the slider valve member of FIG. 3 (taken along line A—A of FIG. 2), the point at which vertical bore 25 intercepts side port 24 defines a cavity within the slider valve having the contour of the interior surface of a partial sphere having a radius R, such that the transition of the bore surface from vertical bore 25 to sidewall port 24 is carried out along the interior surface of such sphere. It has been found that by providing such a smooth bore surface following the contour of a sphere, the greatest potential for maintaining laminar flow of the air traveling through the valve structure is achieved, in turn improving the effectiveness of mixing the air with the fuel injected into the cylinder and thus the overall efficiency of the engine. To further enhance the flow of air through the valve and maintain its laminar nature, the radius R of the portion of the sphere interconnecting vertical bore 23 and side port 24 is preferably the same as the radii of both vertical bore 23 and side port 24, thus eliminating any ridges or narrowing of the flow channel which might inhibit flow or otherwise support the development of turbulent regions within slider valve 20. The formation of such a continuous flow channel may be achieved using a ball mill to bore both vertical bore 23 and side port 24, leaving a concave spherical surface at the points at which these two openings intercept one another.

As mentioned above, slider valve 20 is also equipped with a shallow channel 22 positioned in its external sidewall. Channel 22 is configured with a dimension slightly larger than positioning pin 14 in valve seat housing 10, thus allowing positioning pin 14 to move freely up and down through channel 22 during operation of the valve while preventing rotation of slider valve 20. Thus, when the valve assembly is installed in the head of a cylinder, the air flow produced from the valve when it is in its open position is in a constant, fixed direction.

Figure 4:
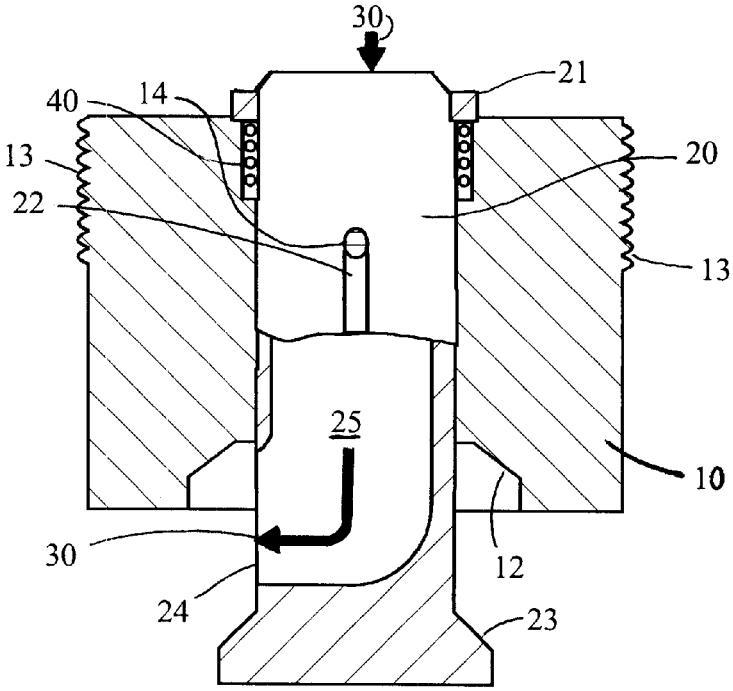
FIG. 4 is a partial, cross-sectional view of the assembled valve in an open position.

Referring now to the partial, cross-sectional view of FIG. 4, when the valve is subjected to a differential pressure of 1 psi or greater so as to create a vacuum on the valve seat side of valve housing 10 (such as during the intake stroke in an internal combustion engine), slider valve member 20 moves downward through valve body 10 until annular ring 21 positioned at the top of slider valve 20 abuts the top face of valve body 10. Rotation of slider valve 20 about its primary axis as it travels through valve body 10 is prevented by the interaction between guide pin 40 with channel 22 on the sidewall of slider valve 20. When slider valve 20 has assumed a fully open position (as shown in FIG. 4), outlet port 24 is fully exposed to the environment within the working chamber, in turn allowing air to flow through slider valve 20 through vertical bore 25 and out from port 24 in a continuous, smooth, laminar stream. A spring 14 is provided within valve housing 20 which acts against annular ring 21 to bias slider valve 20 towards its closed position.

Figure 5:
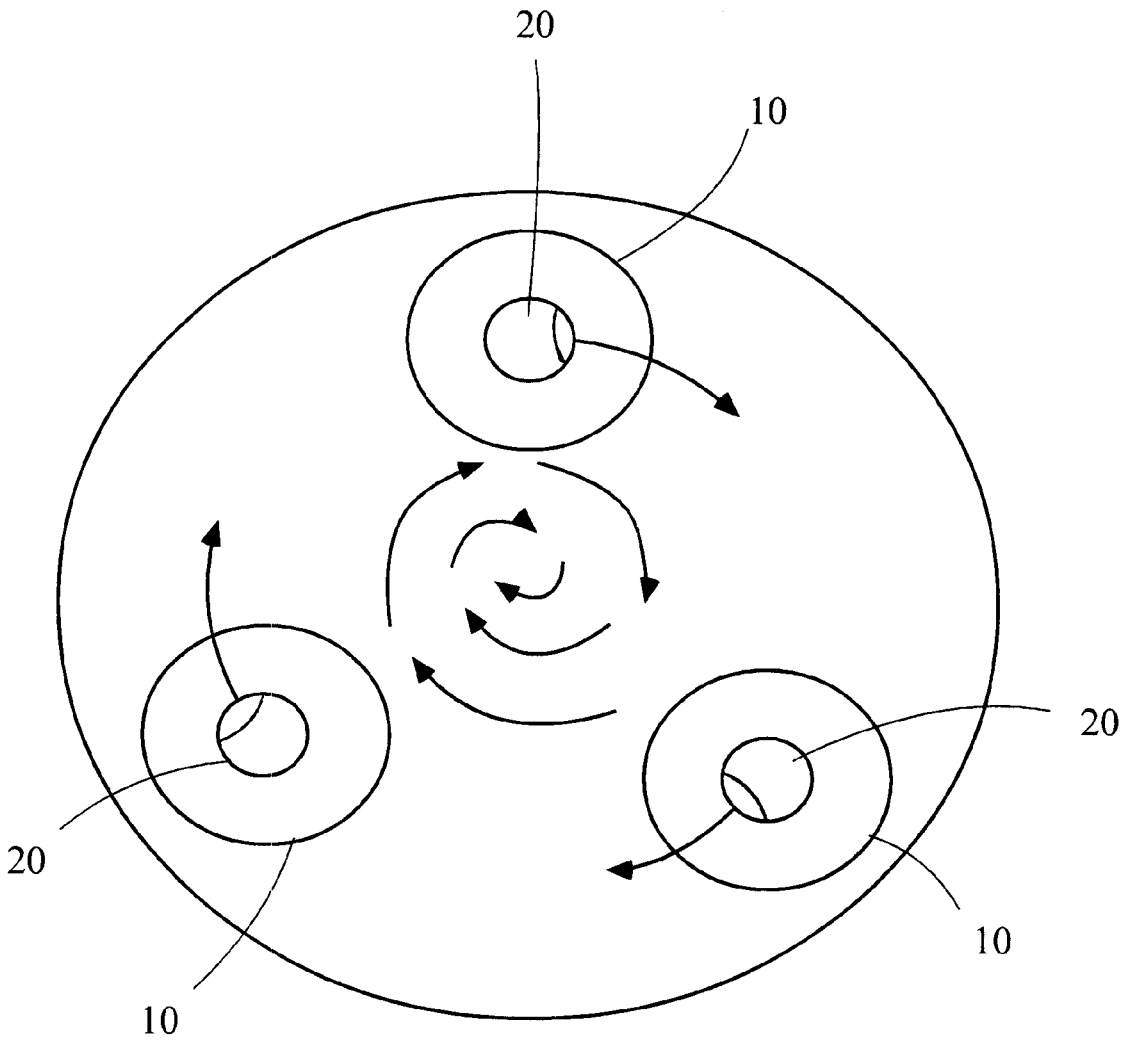
FIG. 5 is a top-down view of a cylinder of an internal combustion engine incorporating the valve of the instant invention.

Finally, as shown in the top-down view of a working chamber of FIG. 5, a plurality of valves as described above may be positioned within the head of the cylinder of an internal combustion engine to introduce a plurality of smooth, continuous, laminar streams of air into the head of the cylinder. Such a combination of flows which produces a swirling effect within the cylinder has been found to have a significant cooling effect on the cylinder, in turn reducing the wear on the cylinder and piston experienced during engine operation. Likewise, the swirling effect produced through the introduction of air from multiple valves of the instant invention provides for more efficient mixing of the fuel/air mixture prior to combustion than has been previously available through prior art devices, in turn providing increased overall engine efficiency and reduced fuel consumption.

As explained in greater detail above, it has been found that this valve arrangement ensures ease of operation of the valve in response to a differential pressure of as little as 1 psi, thus greatly reducing the load exerted on the internal combustion engine of the instant invention during the intake or induction stroke of the induction cylinder, while ensuring a readily responsive transfer of fresh air into the working chamber. The design of the valve of the instant invention provides for automatic, pressure responsive actuation, such that the need for mechanical, electrical, or electromechanical valve actuators is eliminated, while maintaining a vastly simplified construction over previously known valves. Such simplified construction in turn reduces the manufacturing costs of the valve unit.

It should be readily apparent to those of ordinary skill in the art that the improved valve of the instant invention may be applied to various types of internal combustion engines, such as vehicle engines, marine engines, and industrial engines. The improved valve of the instant invention may likewise be applied to internal combustion engines using spark ignition and or incorporating fuel injection systems, as well as diesel engines employing compression ignition.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. For example, multiple devices as described above may be utilized to supply fresh air, and multiple fresh air inlet valves and transfer valves may be provided in order to increase the airflow into each respective cylinder. It should be understood, therefore, that the invention may be practiced otherwise than as specifically set forth herein.

What is claimed is:

1. In an internal combustion engine having at least one working cylinder, said cylinder further comprising a cylinder head, an automatic, pressure responsive air intake valve comprising:

a valve seat housing, said valve seat housing further comprising:

a first bore extending through said valve seat housing from a top face of said valve seat housing to a bottom face of said valve seat housing, said first bore defining a flared valve seat adjacent said bottom face; and a slider valve member configured for reciprocating movement through said bore, said slider valve member further comprising:

an elongate member having an outwardly flared bottom, said outwardly flared bottom configured to mate with said valve seat to close said valve;

guide means for guiding said slider valve through said valve seat housing;

a side port extending into a side wall of said elongate member; and a second bore extending through said slider valve member from a top face of said slider valve member to said side port.

2. The automatic, pressure responsive air intake valve of claim 1, said valve seat housing further comprising:

means for attaching said valve seat housing to an opening in said cylinder head.

3. The automatic, pressure responsive air intake valve of claim 2, said means for attaching said valve seat housing further comprising screw threads circumscribing at least a portion of an exterior surface of said valve seat housing.

4. The automatic, pressure responsive air intake valve of claim 1, said valve seat housing further comprising:

a pin extending radially inward into said first bore in said valve seat housing, said pin engaging said guide means on said slider valve so as to prohibit rotation of said slider valve.

5. The automatic, pressure responsive air intake valve of claim 4, said guide means further comprising a slot extending into said elongate member of said slider valve.

6. The automatic, pressure responsive air intake valve of claim 1, said second bore in said slider valve member further comprising:

a cavity within said slider valve member, said cavity being defined by a sidewall of said second bore and having a contour of a portion of an interior of a sphere;

a first bore section extending generally parallel to a major axis of said slider valve member from said top face of said slider valve member to said cavity; and said side port extending at an angle to said major axis of said slider valve member and terminating at said cavity;

whereby air flowing through said second bore is directed along said major axis, through a turn along the spherical contour of said cavity, and out from said side port while maintaining laminar flow.

7. The automatic, pressure responsive air intake valve of claim 6, wherein said port extends generally perpendicular to said major axis of said slider valve member.

8. The automatic, pressure responsive air intake valve of claim 1, further comprising:

a plurality of said air intake valves positioned within said cylinder head.

9. The automatic, pressure responsive air intake valve of claim 8, each of said valves being positioned so as to direct a flow of air through said valve and in a tangential direction to a radius of said working cylinder, whereby the plurality of air flows from said plurality of valves produce a uniform, swirling airflow within said working cylinder.

10. The automatic, pressure responsive air intake valve of claim 1, said valve seat housing being formed integrally within cylinder head.

* * * * *